United States Patent [19]

Tarassoff

[11] Patent Number: 4,627,361

[45] Date of Patent: Dec. 9, 1986

[54] OVERHEAD CABLE TRANSPORT INSTALLATION WITH REGULAR SPACED LOAD SUPPORTING CARRIAGES

[75] Inventor: Serge Tarassoff, Seyssinet-Pariset, France

[73] Assignee: Pomagalski, S.A., France

[21] Appl. No.: 570,687

[22] Filed: Jan. 13, 1984

[30] Foreign Application Priority Data

Jan. 17, 1983 [FR] France ..... 83 00749

[51] Int. Cl.[4] ..... B61B 11/00; B61B 1/00

[52] U.S. Cl. ..... 104/28; 104/178; 104/173.2

[58] Field of Search ..... 104/178, 173 ST, 168, 104/173 R, 27, 28, 179

[56] References Cited

U.S. PATENT DOCUMENTS

| | | | |
|---|---|---|---|
| 3,426,701 | 2/1969 | Braun | 104/178 X |
| 4,050,385 | 9/1977 | Gurr et al. | 104/178 X |
| 4,223,609 | 9/1980 | Montagner | 104/173 ST |

FOREIGN PATENT DOCUMENTS

| | | | |
|---|---|---|---|
| 0034983 | 9/1981 | European Pat. Off. | 104/173 ST |
| 2060030 | 6/1972 | Fed. Rep. of Germany . | |
| 2645455 | 4/1978 | Fed. Rep. of Germany . | |
| 1401291 | 4/1965 | France . | |
| 2340848 | 9/1977 | France . | |
| 2450187 | 9/1980 | France . | |
| 2504480 | 10/1982 | France . | |
| 284669 | 7/1952 | Switzerland . | |
| 340856 | 10/1959 | Switzerland . | |

*Primary Examiner*—Robert B. Reeves
*Assistant Examiner*—David F. Hubbuch
*Attorney, Agent, or Firm*—Parkhurst & Oliff

[57] ABSTRACT

Gondola lift or chairlift with carriages supporting a gondola or a chair and having a grip for coupling on a continuously moving cable. In the terminals the carriages uncoupled from the cable run without stopping on a transfer rail. The carriages are regularly spaced and the transfer rail comprises a rail section equipped with a rhythm device which controls the release of the carriages at regular time intervals.

4 Claims, 13 Drawing Figures

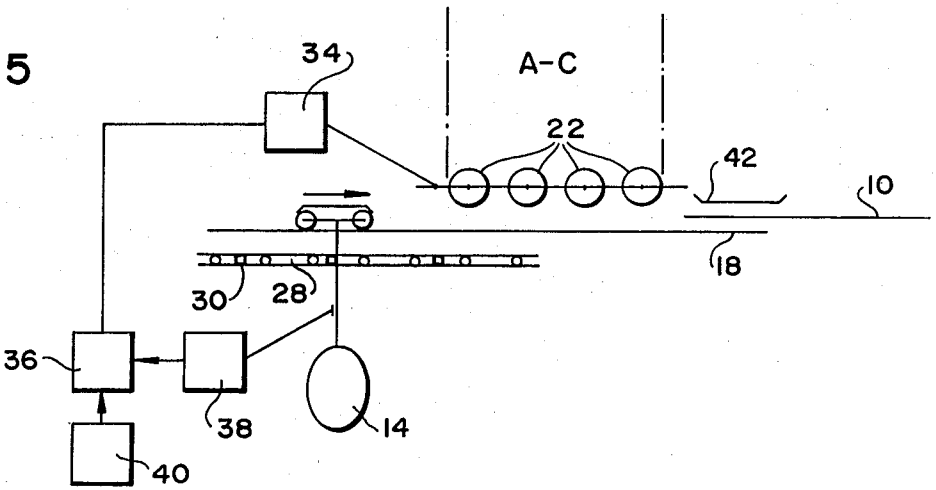
Fig. 5
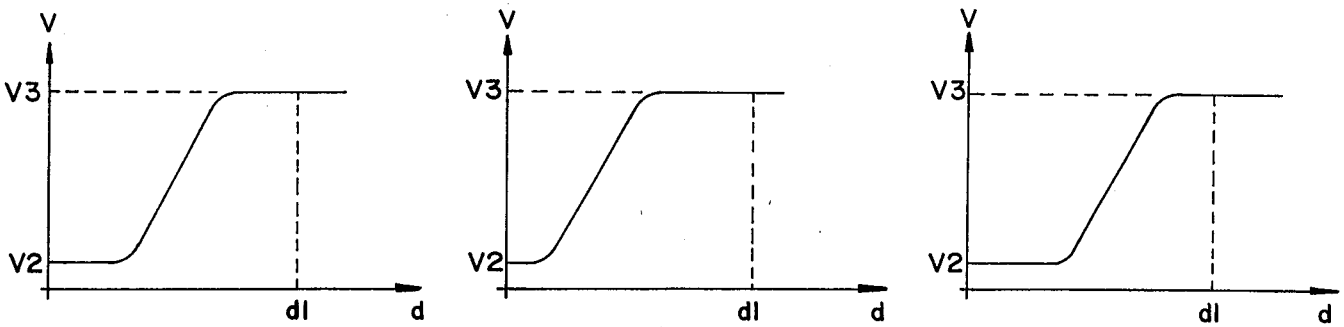
Fig. 6
Fig. 7
Fig. 8

OVERHEAD CABLE TRANSPORT INSTALLATION WITH REGULAR SPACED LOAD SUPPORTING CARRIAGES

BACKGROUND OF THE INVENTION

The invention relates to an overhead cable transport installation, in particular a gondola lift or a chairlift, comprising a carriage with detachable grip for coupling a load, in this case a gondola or a chair, on a continuously moving overhead cable. The grips are of the detachable type permitting the uncoupling of the carriage from the cable in the terminals or stations and the running on a transfer guiding rail at a slow speed or the stopping of the gondola or chair at the loading or unloading platforms. The operations in the terminals are entirely automatic and the supervisor can select, according to the traffic, a suitable hourly capacity, by switching on to the line the number of gondolas or chairs necessary. The loads must be regularly staggered along the line to avoid overloading on some sections of the line. At the beginning of the installation, for instance in the morning, the supervisor switches on to the line the gondolas or chairs at regular predetermined time intervals so that the gondolas or chairs coupled to the cable are regularly spaced. Thereafter the gondolas or chairs circulate along a closed loop trajectory, the carriages being uncoupled from the cable in the terminals. The intervals between the carriages may vary as soon as these carriages are uncoupled from the cable, the decelerating or accelerating speed as well as the running speed on the guiding rails changing for instance with the weight of the transported load. The slight speed differences modify the spacing of the gondolas and these differences are summed up or amplified at each terminal passage. After several passages the gondolas are grouped together. This problem of regular spacing of the loads has been solved in known installations by providing a gondola stock in the terminal and taking from this stock at regular time intervals. This system requires stopping of the gondolas at the entrance of the stock area resulting in the gondolas colliding with each other. The object of this invention is to obtain a regular spacing of the carriages along the line without the necessity of stopping of the carriages, which move continuously as well along the line as in the stations.

SUMMARY OF THE INVENTION

To reach this objective the installation according to the present invention includes at least in one terminal a rhythm device fitted in a rail section on which moves continuously the carriage and which is capable of exerting on the latter a mean high speed when the carriage is lagging behind the others and a mean slow speed on a carriage in advance, in such a manner that the carriages leave the rail section at predetermined regular time intervals, for instance every 5th seconds. At the exit of this rail section with the rhythm device the carriages are regularly spaced regardless of their spacing at their entrance and this time interval remains substantially the same along the whole endless circulating path. The carriages have more or less the same speed and the slight interval differences may be corrected by means of a simple and reliable rhythm device which does not cause shocks.

This rail section is advantageously equipped with two carriage driving means, for instance a first slow speed and a second higher speed driving device. When the carriage is at a correct interval, it is driven by means of the slow speed driving device during the first half-way of this rail section. The second driving device catches up and drives the carriage during the second half-way. The first driving device comprises for instance a free wheel to permit the travelling of the carriage at a greater speed.

When the carriage is lagging behind the others the second driving device catches up and drives the carriage directly at the entrance on this rail section, so that the carriage runs at high speed along the whole length of the rail section and makes up its delay. Inversely, a carriage in advance runs at low speed on the rail section and catches up only at the end of this rail section. In this case the second driving device imparts the rhythm or the frequency at which the carriages leave the rail section, but it is clear that the first driving device may brake the carriage movement and impart the rhythm.

The driving devices may be endless belts, chains or ropes or friction wheels engaging a running surface provided on the carriage. The transport installation can be constructed as a two-cable cableway or a single-cable cableway.

It is advisable to locate the rail section with the rhythm device at the entrance of the station, one of the driving devices being arranged so as to follow or to form a part of the usual carriage decelerating or braking system. When this braking system comprises wheels equipped with a pneumatic tire, capable of engaging the carriage by friction, the wheels at the end of the braking system drive the carriage at a slow speed. The second driving device is for instance a pushing chain having regularly spaced fingers adapted to engage and to push the carriages.

It is desirable that a rail section with a rhythm device is installed in each terminal so as to provide a correct spacing at each departure, but in some installations a device in one terminal may be sufficient. In that case it is advisable to install this rail section at the end of the less loaded line section so as to have a correct spacing on the most loaded line section.

It is likewise possible that the rail section with the rhythm device comprises a variable speed driving motor. A detecting unit detects a difference in spacing between the gondolas and controls the driving motor speed so as to restore the correct rhythm at the exit of the rail section. Such a variable speed rail section forms advantageously a part of the usual accelerating device for accelerating the carriages to the speed of the circulating cable before their coupling to the cable at the exit of the terminal or of the decelerating device at the entrance of the terminal. The detecting unit measures for instance the time interval which separates the passage of two carriages and detects a difference with a set value for monitoring the accelerating or decelerating operation so as to balance this difference. The existing satisfactory type of starting device represents an important part of this rhythm device, so that only a very small number of simple parts such as the detecting unit and the motor control program are additionally required.

BRIEF DESCRIPTION OF THE DRAWINGS

The attached drawings show by way of example, two embodiments of the present invention in which:

FIG. 5 is a schematic view in elevation of an accelerating device equipped with a rhythm device;

FIGS. 6, 7, 8 are graphs of the speeds of a carriage respectively in a normal, in a delayed or in an advanced position;

FIG. 11 is a view similar to FIG. 2;

FIG. 12 is a view similar to FIG. 3; and

FIG. 13 is a view similar to FIG. 4.

DETAILED DESCRIPTION OF THE PREFERRED EMBODIMENTS

Figure 1:
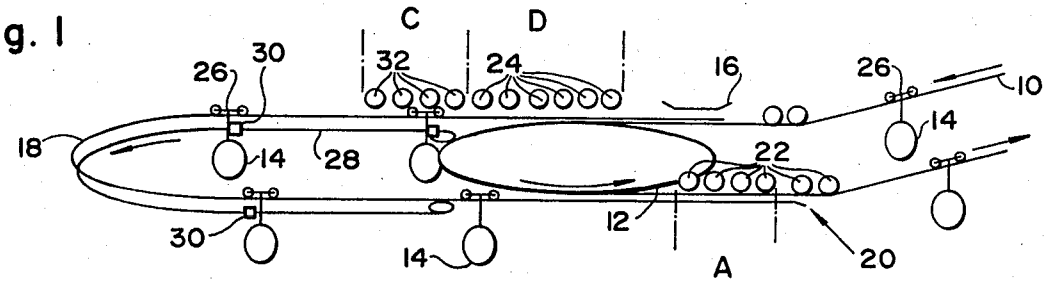
FIG. 1 is a general perspective view of a terminal equipped with a rhythm device according to the invention.

In the figures, a carriage 26 runs on wheels 44 on a rail 18 of a terminal station of an overhead cable transport installation, in particular of a gondola lift or a chairlift. Carriage 26 is equipped with grips 46 for coupling on to a haulage-track cable 10 extended between the two terminals which are identical, only one being shown in FIG. 1. A gondola 14 is carried by a suspension hinged on the grip carriage 26. The grips 46 are of the detachable type permitting the uncoupling of the carriage 26 from the cable 10 at the entrance 16 in the terminals and the running at a slow speed on the transfer rail 18, particularly for the loading or unloading of the passengers. At the exit 20 of the terminal the carriage 26 is accelerated for instance by running on an inclined section of rail or by friction driving wheels 22 engaging the carriage 26 on an accelerating rail section A, before the coupling of carriage 26 on to the cable 10. The cable 10 is moved in an endless path around two end pulleys 12 in the terminal, one of these pulleys being a driving pulley. Cable 10 is continued in the terminal by the transfer rail 18 taken about the end pulley 12 on the left of FIG. 1, so as to provide with the cable a closed loop trajectory of the continuously circulating carriages 26. At the entrance 16 of the terminal the carriage 26 uncoupled from the cable 10 and running on rail 18 is decelerated by six braking wheels 24 staggered along the decelerating rail section D and each equipped with a pneumatic tire which engages a running surface of carriage 26. A transfer chain 28 having push fingers 30 which engage the carriage 26, extends along the transfer rail 18. The chain 28 is driven by a motor (not shown) at a constant speed $V_2$ to push the carriages 26 running on the rail 18 towards the exit of the terminal. Such a gondola lift or chair lift is well known and for instance described in the U.S. Pat. No. 3,416,462, the disclosure of which is herein incorporated by reference. four driving wheels 32, identical with the braking wheels 24. The driving wheels 32 are interconnected and driven by a motor at a constant linear speed $V_1$. The chain 28 extends along the rail section C, the chain speed $V_2$ being higher than the driving wheel speed $V_1$. When the carriage 26 is coupled to the driving chain 28 and also to the driving wheels 32, the chain action prevails and the carriage 26 moves at the higher speed $V_2$, the carriage slipping on wheels 32 or a free wheel (not shown) permitting these wheels 32 to rotate more rapidly in the sense of movement of the carriage than the driving speed transmitted by the motor.

The driving fingers 30 secured to the chain 28 are regularly spaced along the chain 28 and they push the regularly spaced carriages towards the exit of the terminal.

Figure 2A:
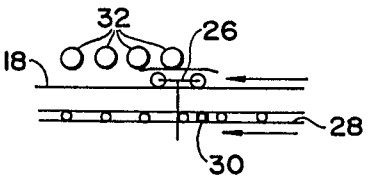
FIG. 2 illustrates the rhythm device of FIG. 1, on a larger scale, showing a load carriage at normal interval.
Figure 2B:
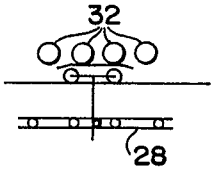
Figure 4A:
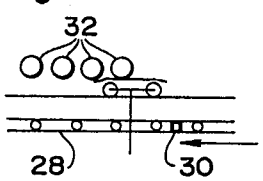
FIG. 4 is a view similar to FIG. 2 of a carriage in advance.
Figure 4B:
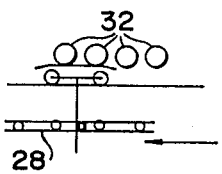
Figure 9:
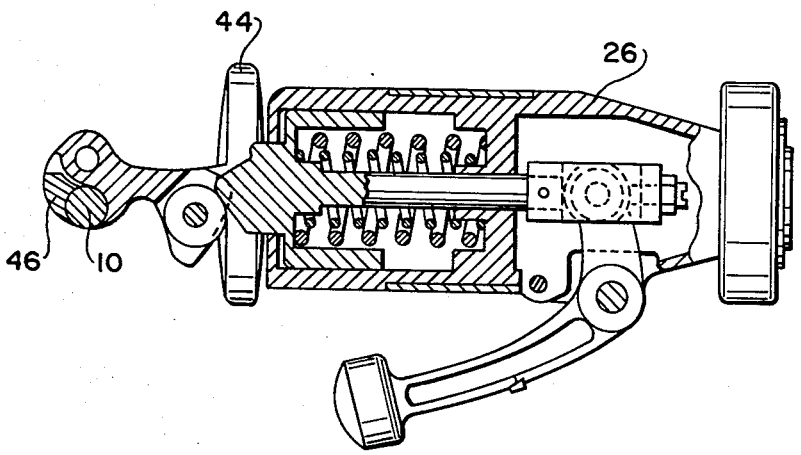
FIG. 9 shows a cross-sectional view of a carriage of FIG. 1.

The rhythm device operates in the following manner:

When the spacing or time interval between the carriages 26 is normal, the carriage 26 uncoupled from the cable 10 at the entrance 16 of the terminal, is braked by the braking wheels 24 on the decelerating rail section D and the carriage 26 entering the rail section C being driven by the wheels 32 at a speed $V_1$ (FIG. 2). The carriage 26 is caught by the driving finger 30 in the middle length of the rail section C and thereafter it runs at a speed $V_2$ (FIG. 11). The mean travel speed on rail section C is $(V_1+V_2)/2$.

Figure 3A:
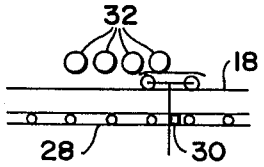
FIG. 3 is a view similar to FIG. 2 of a delayed carriage.
Figure 3B:
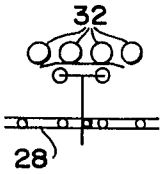

When the carriage 26 has been delayed during its travel it enters rail section C a little later (FIG. 3) and the driving finger 30 catches up to the carriage before the middle length, for instance directly at the entrance of rail section C. The carriage 26 runs at high speed $V_2$ along the whole section C and leaves this section at the normal time interval. Inversely, a carriage 26 in advance will be driven at speed $V_2$ by the finger 30 only on the end part of rail section C (FIG. 13) and is automatically brought at the right spacing without stopping of the carriage, which runs continuously in the terminals. The spacing of the carriages 26 corresponds exactly to the spacing of the driving fingers 30 of chain 28. It is clear that rail section C with the rhythm device may be separated from decelerating section D and that the length of section C is sufficient to balance the greatest spacing differences occurring during the travel. The chain 28 could be a rope or any other suitable driving means.

The hereafter described rhythm device comprises two driving devices, chain 28 and friction wheels 32, for varying the mean travel speed of the carriage on a rail section C.

Figure 10:
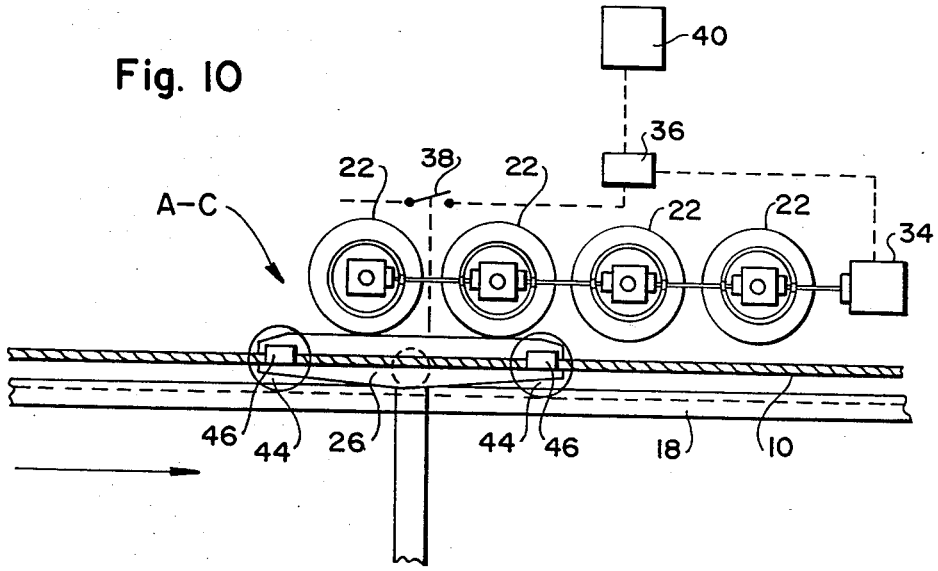
FIG. 10 shows a side view of a carriage accelerating device.

According to a variant represented in FIGS. 5 and 10, the rail section C is included in the accelerating rail section A equipped with four friction driving wheels 22. A friction wheel accelerating system of this kind is for instance described in U.S. Pat. No. 4,210,019. The friction wheels 22 are driven by an electric variable speed motor 34 connected to a unit 36 supplying power to and monitoring motor 34. Immediately before the rail section A-C an electric switch 38 will operate every time that a carriage 26 moves past its location, which indication, given to unit 36 together with a clock signal of a clock 40, provide information as to the effective time intervals of the carriages 26, particularly the differences with the predetermined time intervals or frequency. In accordance with this difference, unit 36, which comprises for instance a variable shunt resistor, controls the speed V of motor 34. The speed "V" of a carriage 26 in the different positions "d" on the rail section A-C is shown in FIGS. 5–7 respectively for a carriage 26 at normal time interval, at delayed interval and at advanced interval. On these diagrams it will be seen that the mean speed of the carriage shown in FIG. 8 is smaller than that in FIG. 6, which is smaller than that in FIG. 7, so as to balance the interval differences. This rhythm or balance device has the advantage that it needs only a few additional parts, in particular the switch 38 and a modified motor control unit 36. Motor speed control devices are of course well known.

I claim:

1. An overhead cable transport installation, in particular a gondola lift or a chairlift, comprising:

a continuously moving endless overhead cable extending between two terminals, a plurality of carriages each supporting a gondola or a chair and having a detachable grip for coupling on said cable, a transfer rail in each terminal for connecting an inward line and an outward line constituted by said endless cable so as to form with said lines an endless travel path on which the carriages move continuously without stopping, and a rail section of said transfer rail equipped with a rhythm device, the rhythm device including a first carriage driving means for driving the carriage at slow speed during a first travel time on said rail section, a second carriage driving means for driving the carriage at higher speed during a second travel time on said rail section, said travel times being variable, the length of the first travel time varying inversely with the length of the second travel time so as to change the mean travel speed of said carriage and the whole travel time on said rail section and to monitor the carriage intervals.

2. The overhead cable transport installation according to claim 1, in which one of said first and second carriage driving means comprises a continuously moving endless chain having carriage driving fingers regularly staggered therealong at an interval corresponding to a set value for a carriage interval.

3. The overhead cable transport installation according to claim 2, wherein the entrance of each terminal has a carriage decelerating device which extends along said rail section.

4. The overhead cable transport installation according to claim 3, wherein said endless chain extends along the whole length of said transfer rail for continuously moving the carriages at regular intervals in said terminal.

* * * * *